US006379265B1

(12) United States Patent
Hirakawa et al.

(10) Patent No.: US 6,379,265 B1
(45) Date of Patent: Apr. 30, 2002

(54) STRUCTURE AND METHOD OF FASTENING A WEIGHT BODY TO A GOLF CLUB HEAD

(75) Inventors: Tatsuya Hirakawa; Atsushi Uchida, both of Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 09/466,102

(22) Filed: Dec. 17, 1999

(30) Foreign Application Priority Data

Dec. 21, 1998 (JP) ..... 10-362170

(51) Int. Cl.[7] ..... A63B 53/04; A63B 53/06
(52) U.S. Cl. ..... 473/338; 473/345; 473/349
(58) Field of Search ..... 473/324, 291, 473/334, 335, 336, 337, 338, 339, 345, 346, 349, 347, 348, 344

(56) References Cited

U.S. PATENT DOCUMENTS 2,163,091 A * 6/1939 Held
2,198,981 A * 4/1940 Sullivan
3,909,005 A * 9/1975 Piszel
4,052,075 A * 10/1977 Daly
5,935,019 A * 8/1999 Yamamoto
6,033,321 A * 3/2000 Yamamoto
6,203,448 B1 * 3/2001 Yamamoto

FOREIGN PATENT DOCUMENTS

JP H10-94623 4/1998

* cited by examiner

*Primary Examiner*—Sebastiano Passaniti
(74) *Attorney, Agent, or Firm*—Koda & Androlia

(57) ABSTRACT

A metal wood golf club head including a sole plate and a weight body which is fastened to this sole plate via a spacer. A recess which accommodates the spacer and weight body is formed in a portion of the sole plate, an undercut part is formed in the inside circumferential portion of the recess, and a circumferential groove is formed in the outer circumferential portion of the weight body. When the weight body is press-fitted in the recess with the spacer in between, the spacer is forcibly engaged with the undercut part and circumferential groove, thus allowing the weight body to be firmly fastened to the recess of the sole plate of the club head.

9 Claims, 4 Drawing Sheets

STRUCTURE AND METHOD OF FASTENING A WEIGHT BODY TO A GOLF CLUB HEAD

BACKGROUND OF THE INVENTION

1. Field of the Invention

The present invention relates to a golf club head and more particularly to a structure and method for fastening a weight in a metal-wood golf club head.

2. Prior Art

Among golf clubs, those called "woods" are required to contribute to increase the traveling distance of a struck golf ball. Therefore, the overall weight of recent clubs has been reduced by forming the club head from a light metal such as titanium, etc., and the weight body consisting of a metal with a large specific gravity is embedded inside the club head in order to increase the moment of inertia.

In one method to attach such a weight body to the club head, an externally-threaded screw is formed on the outer circumferential surface of a weight body and an internally-threaded screw hole is formed in the ground-contacting surface of the club head, i.e., in the sole plate of the club; and the weight body is screwed to the club head. In another method, a weight body is accommodated in a recess formed in the sole plate of the club head and fastened in place by an adhesive, etc.

However, in the above screw-engagement structure, a slight gap is unavoidably generated between the sole plate and the weight body for structural reasons. As a result, the style of the club in terms of external appearance is not always favorable. Furthermore, as the club is repeatedly used, the weight body may shift in position or drop out of the club head as the screw is loosened. Accordingly, such clubs lack stability in terms of product precision. On the other hand, in the above-described bonding structure of the weight body to the club head, a slight gap is also inevitable between the sole plate and the weight body. In addition, in such an adhesive bonding structure, the fastening strength drops as a result of deterioration of the adhesive agent over time, etc. Thus a weight body with a mass that effectively increases the moment of inertia cannot be employed.

Japanese Patent Application Laid-Open (Kokai) No. H10-94632 discloses a structure in which a weight body consisting of a different material from the sole plate is fastened to the sole plate. The weight body is welded to the sole plate via a spacer that is made of the same metal as the sole plate. However, in this weight body fastening structure, it is necessary to first wrap a band-form spacer around the outer circumferential surface of the weight body so as to fasten the spacer to the weight body, then to press-fit the weight body on which the spacer has been mounted in a seating part (accommodating section) formed in the sole plate, and further to fasten the spacer and sole plate to each other by welding.

In other words, in this fastening structure disclosed in the Japanese Laid-Opened Patent Application, though the spacer and the weight body are engaged, the strength of such an engagement of the spacer and the sole plate depends on welding. Accordingly, it is necessary to perform a separate welding process when the weight body is fastened to the sole plate. Thus, the work of fastening the weight body to the sole plate requires extra steps, hindering an easy mounting of the weight body to the club head. Furthermore, in the above method, the welding precision plays an important role in the precision of the final product; accordingly, the work requires extreme skill. In addition, a long manufacturing time is required, the productivity tends to be low, and these problems are inevitably reflected in the cost of the product.

SUMMARY OF THE INVENTION

Accordingly, the main object of the present invention is to solve the above-described problems in the prior art golf club head.

Another object of the present invention is to provide a fastening structure and fastening method of a weight body in a golf club head which allows easy mounting of the weight body to the club head and accomplishes firm fastening of the weight body to the club head.

Still another object of the present invention is to provide a fasting structure and fastening method of a weight body in a golf club head which improves the style of a golf club head in terms of the external appearance of the golf club head.

In order to accomplish the above-described objects, in the present invention, a first engaging part is formed in an accommodating section formed in a golf club head and a second engaging part is formed in a weight body that is to be installed in the club head; and a spacer is forcibly engaged with such first and second engaging parts when the weight body is press-fitted into the accommodating section with the spacer in between, so that the spacer expands and securely holds the weight body in the golf club head.

With the structure above, there is no need to perform any fastening work such as welding, etc.; and the weight body can easily be mounted in the accommodating section of the club head. Furthermore, not only is the weight body press-fitted inside the accommodating section, but the spacer also forcibly engages with the first and second engaging parts; thus the weight body is firmly fastened to the accommodating section. As a result, a golf club with the required large moment of inertia and low center of gravity is obtainable at a low cost. In addition, since the weight body is press-fitted in the accommodating section with the spacer in between, the spacer is interposed between the weight body and the accommodating section without any gaps. Accordingly, the style of the club head in terms of external appearance is not deteriorated.

It is desirable that the first engaging part be in the form of a groove or undercut which is provided in the inner circumferential portion of the accommodating section of the club head and that the second engaging part be in the form of a groove or recess which is formed in the outer circumferential portion of the weight body. With this structure, the spacer can securely engage with the first and second engaging parts.

It is preferable that the spacer be formed from a material which has an elongation of 10% or greater. With this selection of the material, portions of the spacer can be easily entered in the first and second engaging parts, and the press-fitting force applied to the weight body can be reduced. Thus, an easier mounting of the weight body to the accommodating section can be accomplished. In addition, with an employment of such a spacer, a pressing machine which is not a high-capacity type can be used in the manufacture of the club head of the present invention, and the productive facilities can be simplified.

In the description of the present specification, the term "elongation of the spacer" generally refers to the breaking elongation measured using the tensile test method for metal materials specified in JISZ 2241 in the range of 5° C. to 35° C. (20° C.±2° C. in the case of metals sensitive to temperature changes).

DETAILED DESCRIPTION OF THE PREFERRED EMBODIMENTS

Embodiments of the present invention will be described below with reference to the accompanying drawings.

Figure 1:
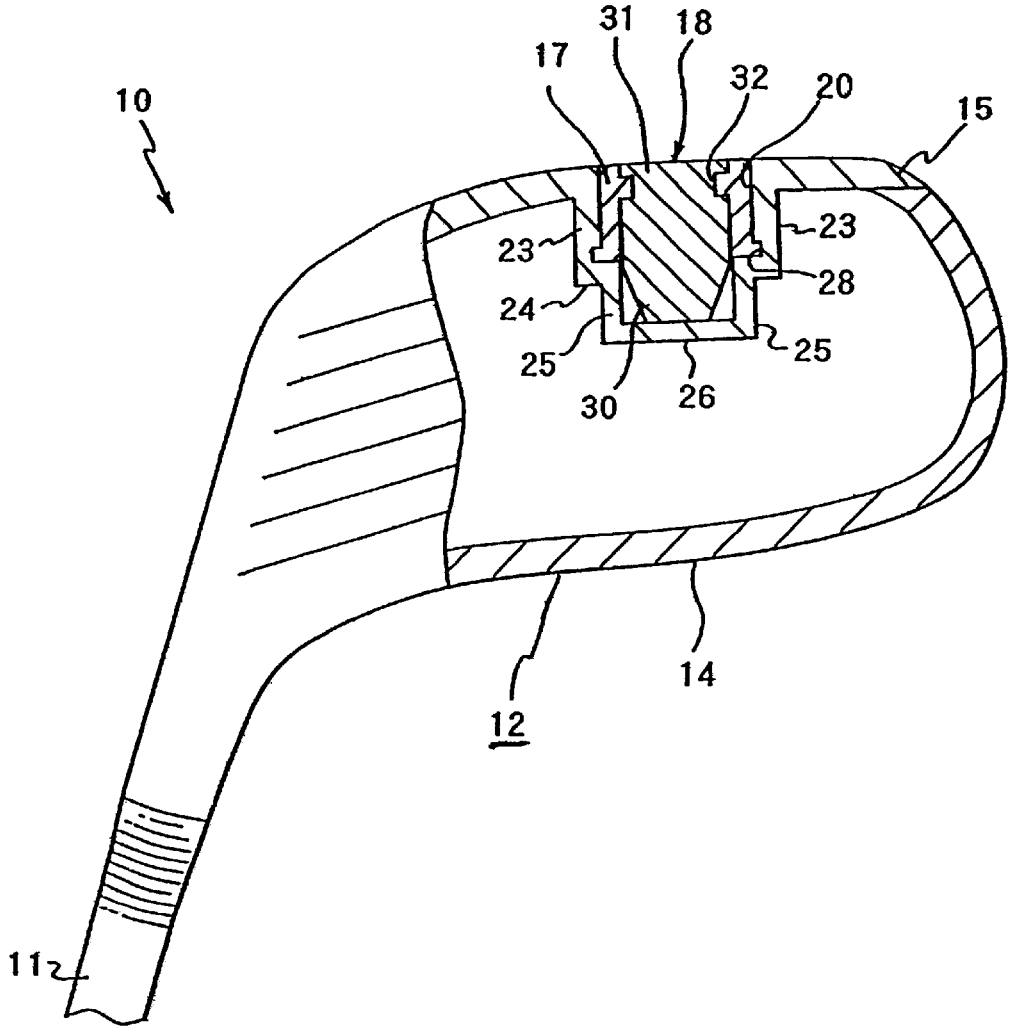
FIG. 1 is a partial sectional view of a golf club head according to one embodiment of the present invention.
Figure 2A:
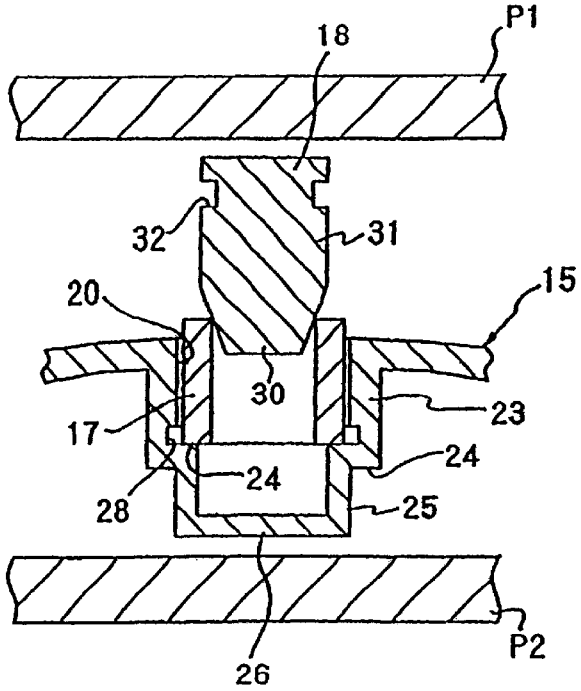
FIGS. 2A, 2B and 2C are exploded illustrations of the weight body, spacer and a part of the golf club head of FIG. 1.
Figure 2B:
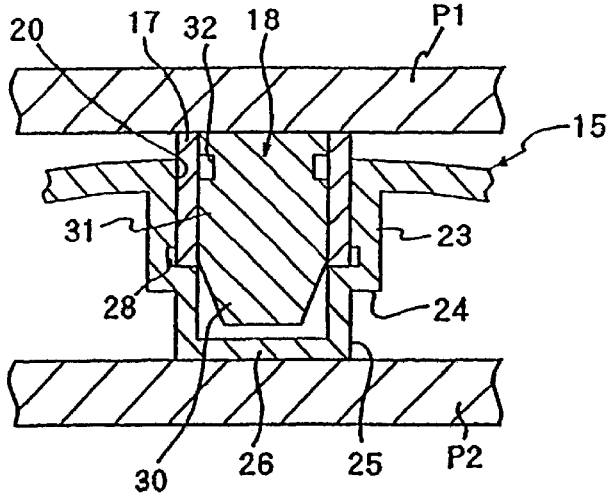
Figure 2C:
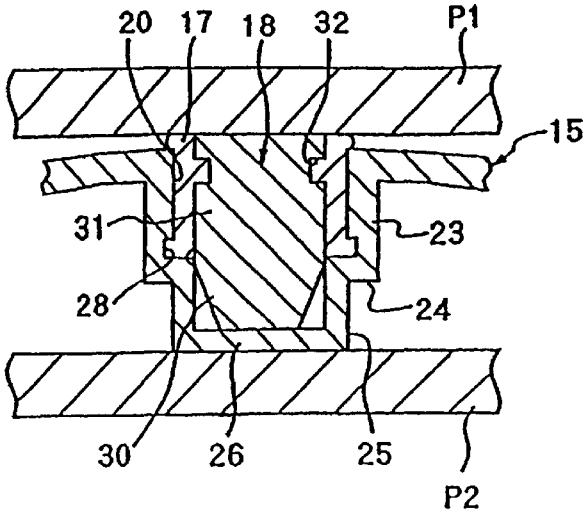

For the sake of convenience of description, the "upper portions," "upper ends" and "upper surfaces" of the respective constituting elements of the present invention will be taken to indicate respective regions at the upper ends of such elements as shown in FIGS. 1 and 2, while the "lower portions," "lower ends" and "lower surfaces" will be taken to indicate respective regions at the lower ends of such members as shown in these Figures.

In FIGS. 1 and 2, the golf club 10 comprises a shaft 11 and a metal club head 12 which is attached to the tip end of the shaft 11. The club head (or merely "head") 12 is constructed from a hollow main body shell 14, which forms the external shape of the head, a sole plate 15, which is disposed on the upper end of this main body shell 14 and forms the ground-contacting surface during use of the golf club 10; in addition, a weight body 18 is fastened to this sole plate 15 via a spacer 17.

A recess 20 which acts as an accommodating section that accommodates the spacer 17 and weight body 18 therein is formed in a portion of the sole plate 15.

This recess 20 has a shape of somewhat a stepped cylinder with a bottom 26. The diameter of the lower region of the recess 20 is smaller than the diameter of the upper region of the recess 20. More specifically, the recess 20 comprises: a first circumferential wall 23 which is round and formed vertically downward from the sole plate 15, a round flange-form step portion 24 which is connected to the lower end of the first circumferential wall 23, a second circumferential wall 25 which is round and formed vertically downward form the inner end of the step portion 24, and a bottom wall 26 which is connected to the lower end of the second circumferential wall 25.

An undercut part 28 used as a groove-form first engaging part that extends in the circumferential direction of the recess 20 is formed as a single groove running entirely around the inner circumferential portion of the first circumferential wall 23 so as to be at the lower end of this wall 23.

The spacer 17 is in the shape of a hollow cylinder with both ends opened and is made from a metal with good expansion and contraction properties such as copper, etc. As best seen from FIGS. 2A through 2C, the external diameter D1 of the spacer 17 is substantially the same as or slightly smaller than the internal diameter D2 of the first circumferential wall 23 of the recess 20. As a result, the spacer 17 can be inserted into the recess 20 of the club head 10 without difficulty. Furthermore, the height H1 of the spacer 17 prior to the insertion of the spacer into the recess 20 is greater than the distance (or depth) H2 which is from the upper end to the lower end of the first circumferential wall 23 of the recess 20. It is desirable that a ductile material with an elongation of 10% or greater be selected for the spacer 17, and any material that satisfies this condition may be used.

The weight body 18 is a solid piece made from a metal with a specific gravity of 10 or greater which is different from the material of the main body shell 14 or the sole plate 15 of the club head 12. The weight body 18 comprises a tapered portion 30 which is formed on the tip end, i.e., the lower end, of the weight body 18 and a cylindrical portion 31 which extends from the upper end of this tapered portion 30; and a single circumferential groove 32 is formed around the entire circumference of the cylindrical portion 31 so as to be located in the upper area of the cylindrical portion 31. The height H3 of the tapered portion 30 is substantially the same as the distance (or the depth) H4 which is from the upper surface of the bottom wall 26 to the lower end of the first circumferential wall 23 of the lower end of the recess 20. Thus, when the weight body 18 is completely accommodated in the recess 20, the tapered portion 30 is positioned inside the second circumferential wall 25. The external diameter D3 of the upper end area of the cylindrical portion 31 is larger than the internal diameter D4 of the spacer 17 and is substantially the same as the internal diameter D5 of the round second circumferential wall 25 of the recess 20.

Figure 3A:
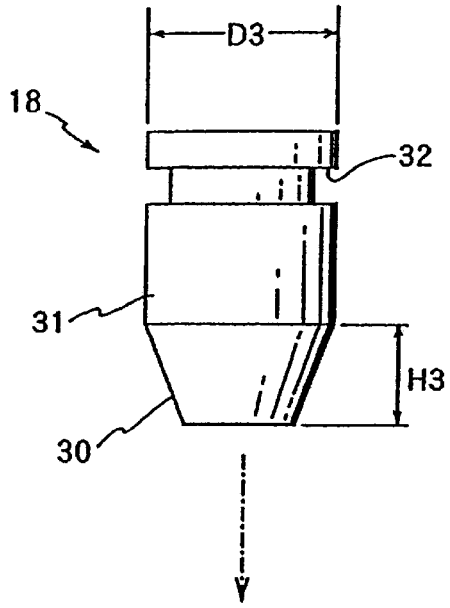
FIGS. 3A, 3B and 3C show the steps of fastening the weight body to the accommodating section of the club head.

The weight body 18 is installed in the accommodating section or the recess 20 so as to be fastened therein in the following manner:

The spacer 17 is inserted into the interior of the recess 20 that is formed in the sole plate 15, so that the lower end of the spacer 17 is seated on the step portion 24 of the recess 20. The recess 20 is formed in the sole plate 15 by casting, forging, mechanical working, drawing or other appropriate methods. When the spacer 17 is thus brought into the recess 20, since the height H1 of the spacer 17 is greater than the height (depth) H2 of the first circumferential wall 23, the upper end of the spacer 17 protrudes slightly from the upper surface of the sole plate 15, thus forming a surplus margin for pressing as shown in FIG. 3A.

Figure 3B:
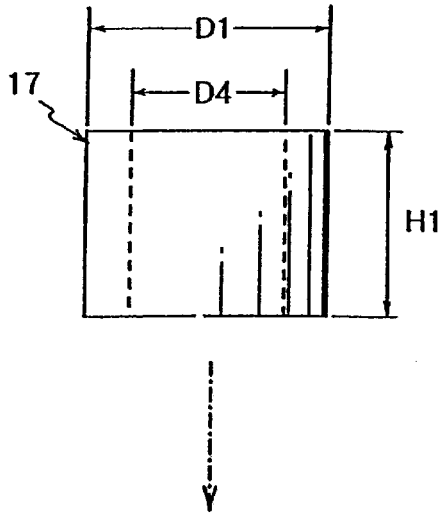

Afterward, the weight body 18 is inserted into the interior of the spacer 17 with the tapered portion 30 first. Then, a press-fitting force is applied to the spacer 17 from the upper-surface side of the weight body 18 by pressing dies P1 and P2. As a result, the spacer 17 elongates while expanding its internal diameter as shown in FIG. 3B; and the cylindrical portion 31 of the weight body 18 is press-fitted inside the spacer 17, and the upper-end surface of the weight body 18 is positioned on substantially the same plane as the upper-end surface of the spacer 17.

Figure 3C:
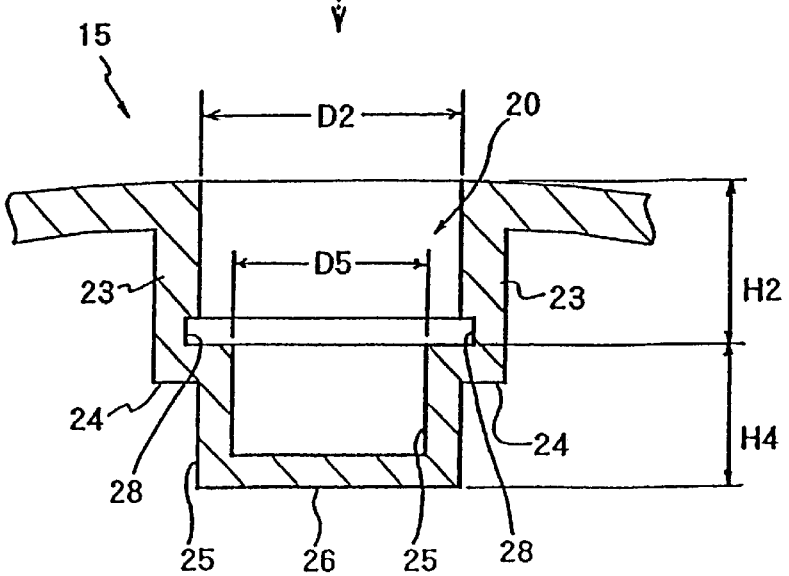

Then, a press-fitting force is further applied to both the spacer 17 and the weight body 18 by the pressing dies P1 and P2. As a result, the weight body 18 is moved further downward so that the lower end of the weight body 18 comes into contact with the bottom wall 26 of the recess 20 as shown in FIG. 3C. At the same time, portions of the spacer 17 are deformed as a result of the compression of the spacer 17, and these deformed portions enter the undercut part 28 of the recess 20 and the circumferential groove 32 of the weight body 18. Thus, both the undercut part 28 of the recess 20 and the circumferential groove 32 of the weight body 18 act as relief areas. In this case, since the external diameter D3 of the cylindrical portion 31 of the weight body 18 is substantially the same as the internal diameter D5 of the round second circumferential wall 25 of the recess 20, and also the height H3 of the tapered portion 30 of the weight body 18 is substantially the same as the height H4 of the second circumferential wall 25 of the recess 20, portions of the deformed spacer 17 will not enter the interior region of the second circumferential wall 25. As a result, the spacer 17 is forcibly engaged with the undercut part 28 of the recess 20 and the circumferential groove 32 of the weight body 18, and the weight body 18 is firmly fastened in the recess 20.

The upper ends of the spacer 17 and weight body 18 protrude slightly from the sole plate 15, and these protruding portions are planed away in the finishing process. Thus, the final products with an evenly flat sole surface such as that shown in FIG. 1 are obtained.

As seen from the above, in the shown embodiment, since the spacer 17 is engaged with both the undercut part 28 of the recess 20 of the sole plate 15 and the circumferential groove 32 of the weight body 18, there is no need for any means such as welding, etc.; and the weight body 18 can easily be mounted in the sole plate 15, and the weight body 18 is firmly fastened therein. After the weight body 18 is installed in the sole plate 15 with the spacer 17 in between, the main body shell 14 is mounted on the sole plate 15, thus obtaining the metal golf head 12 with the weight body 18 inside.

Accordingly, a golf club with the large moment of inertia can be obtained at a low cost. The center of gravity of the head 12 can be positioned inward, and the center of gravity of the head 12 can be lowered.

Furthermore, with the deformation of the spacer 17, the spacer 17 is interposed between the first circumferential wall 23 of the recess 20 and the weight body 18 without leaving any gaps. Accordingly, the style of the head 12 in terms of external appearance can be improved, and a club head 12 that has a reduced air resistance can be obtained.

Figure 4:
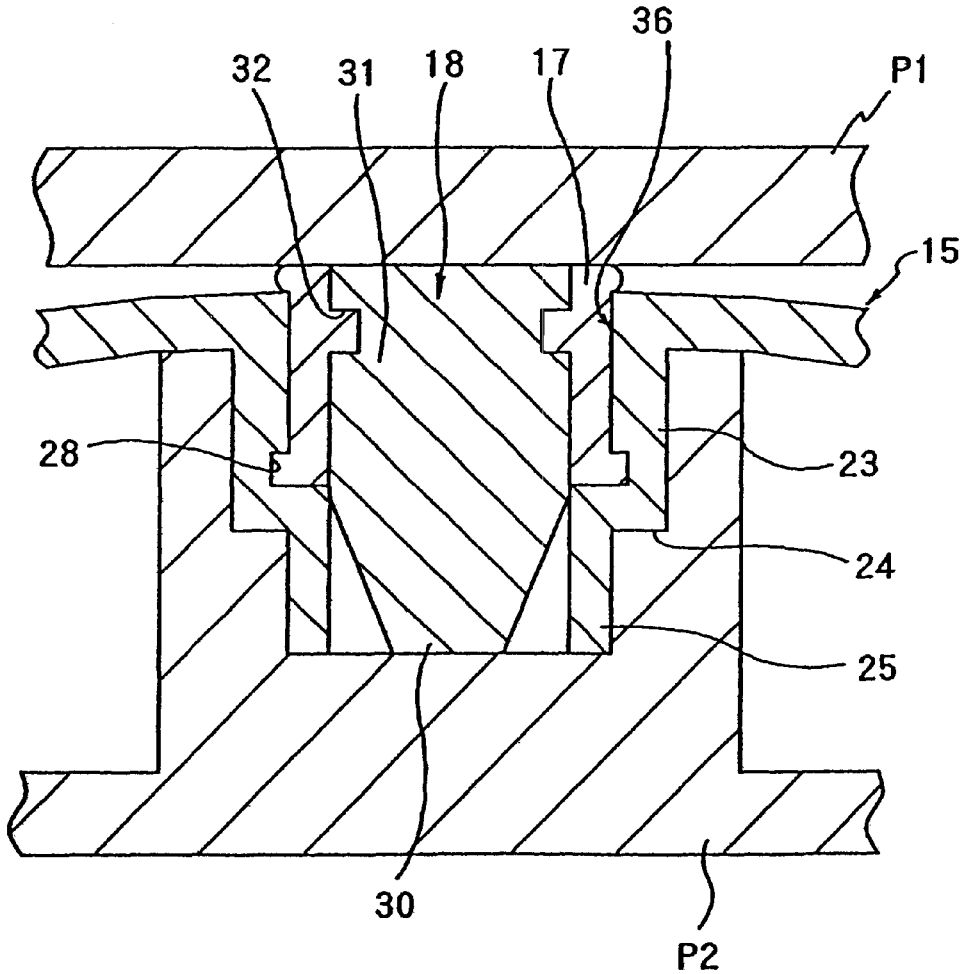
FIG. 4 shows another embodiment of the present invention.

In the above-described embodiment, the accommodating section is the recess 20 that has the bottom wall 26. However, the present invention is not limited to this. For instance, the recess 20 of the sole plate 15 can be formed without the bottom wall 26 and accordingly in a form of a through-hole 36. In this case, the pressing die P2 as shown in FIG. 4 is used that has a cylindrical recess snugly fitted to the outer surfaces of the first circumferential wall 23, flange-form step portion 24 and second circumferential wall 25 of the recess 20.

Furthermore, the shapes of the constituting elements such as the spacer 17, weight body 18, and recess 20, for instance, of the present invention are not limited to the shapes employed in the shown embodiments; and various modifications are possible as long as the spacer 17 is caused to engage with both a portion of the weight body 18 and a portion of the recess 20. For example, the undercut part 28 of the recess 20 can be formed partially and not for the entire inner circumference of the recess 20, or it can be formed as a plurality of holes that penetrate the first circumferential wall 23. Also, instead of the circumferential groove 32, discontinuous recesses can be formed in the weight body 18. Moreover, the spacer 17, weight body 18 and recess 20 can be formed with columnar-prism shapes or with shapes of some other type other than those shown in the drawings which are substantially circular cylindrical shapes. In addition, the respective numbers of undercut parts 28 and circumferential grooves 32 are not limited to one each; and a plurality of such undercut parts 28 and circumferential grooves 32 can be formed in the recessed area and weight body, respectively. With these plural undercut parts and circumferential grooves, the weight body 18 can be secured much more firmly to the recess 20 of the sole plate 15.

As seen from the above, a first engaging part is formed in an accommodating section of a sole plate, a second engaging part is formed in a weight body, and a spacer is forcibly engaged with these first and second engaging parts when the weight body is press-fitted into the accommodating section with the spacer in between. Accordingly, there is no need for any additional fastening operations such as welding, etc. The weight body is easily fitted in the accommodating section and firmly fastened therein. In addition, since the spacer is interposed between the weight body and the accommodating section without any gaps in between, the style of the club head in terms of external appearance is not deteriorated.

Furthermore, since the first engaging part is a groove or undercut formed in the inside circumferential portion of the accommodating section, and the second engaging part is a groove or recess formed in the outer circumferential portion of the weight body, the spacer is engaged securely with these first and second engaging parts.

In addition, since the spacer is formed from a material which has an elongation of 10% or greater, the press-fitting force applied to the weight body can be low, the weight body can be mounted in the accommodating section very easily, and the productive facilities can be simplified.

What is claimed is:

1. A metal golf club head with an elongated weight body which is provided within an accommodating section of said golf club head by means of a fastening structure, wherein said fastening structure comprises a first engaging part formed in said accommodating section, a second engaging part formed in said weight body, and a resilient spacer engaged with said first and second engaging parts when said weight body is press-fitted in said accommodating section with said spacer in between, and wherein said first and second engaging parts are formed respectively at different positions displaced from each other.

2. The golf club head according to claim 1, wherein said first engaging part is a groove which is formed in an inner circumferential portion of said accommodating section.

3. The golf club head according to claim 1, wherein said first engaging part is an undercut which is formed in an inner circumferential portion of said accommodating section.

4. The golf club head according to claim 1, wherein said second engaging part is a groove which is formed in an outer circumferential portion of said weight body.

5. The golf club head according to claim 1, wherein said second engaging part is a recess which is formed in an outer circumferential portion of said weight body.

6. The golf club head according to claim 1, wherein said spacer is formed from a material that has an elongation of 10% or greater.

7. The golf club head according to claim 6, wherein said spacer is a hollow cylinder having an inner diameter and an outer diameter of a predetermined size, said accommodating section has an inner diameter larger than said outer diameter of said hollow cylinder, and said weight body is a solid cylidrical body having an outer diameter larger than said diameter of said spacer.

8. The golf club head according to claim 1, wherein said spacer is a hollow cylinder having an inner diameter and an outer diameter of a predetermined size, said accommodating section has an inner diameter larger than said outer diameter of said hollow cylinder, and said weight body is a solid cylindrical body having an outer diameter larger than said inner diameter of said spacer.

9. The golf club head according to claim 1, wherein said accommodating section comprises a stepped cylinder provided in a sole plate of said golf club head and a bottom member closing a bottom of said stepped cylinder and wherein said first engaging part is a circumferential groove provided around a bottom of a first step of said stepped cylinder, said spacer is cylindrical in shape with a height of said spacer substantially equal to a depth of said first step, said second engaging part is another circumferential groove provided in said weight body adjacent a top of said first step of said stepped cylinder and said weight body is provided entirely within said stepped cylinder.

* * * * *

UNITED STATES PATENT AND TRADEMARK OFFICE

CERTIFICATE OF CORRECTION

PATENT NO. : 6,379,265 B1
DATED : April 30, 2002
INVENTOR(S) : Tatsuya Hirakawa et al.

It is certified that error appears in the above-identified patent and that said Letters Patent is hereby corrected as shown below:

Title page,
Item [54], Title, change "STRUCTURE AND METHOD OF FASTENING A WEIGHT BODY TO A GOLF CLUB HEAD" to -- A METAL GOLF CLUB HEAD --

Signed and Sealed this

Fifteenth Day of June, 2004

JON W. DUDAS
*Acting Director of the United States Patent and Trademark Office*